US005452793A

United States Patent [19]

DiMeo, Jr., et al.

[11] Patent Number: 5,452,793

[45] Date of Patent: Sep. 26, 1995

[54] BUSINESS CARD CASE

[75] Inventors: Anthony DiMeo, Jr., Johnston, R.I.; Ronald J. Medeiros, Seekonk, Mass.

[73] Assignee: Quality Stampings, Inc., Providence, R.I.

[21] Appl. No.: 305,577

[22] Filed: Sep. 14, 1994

[51] Int. Cl.[6] ..... A45C 11/18; B65D 79/00

[52] U.S. Cl. ..... 206/39; 206/45.13

[58] Field of Search ..... 206/39, 39.4, 39.5, 206/39.6, 44.12, 45.13, 45.15, 45.16, 45.18; 150/147, 149

[56] References Cited

U.S. PATENT DOCUMENTS

| | | | |
|---|---|---|---|
| 1,470,709 | 10/1923 | Cook . | |
| 2,020,797 | 11/1935 | Pabst, Jr. . | |
| 2,430,707 | 11/1947 | Cahn | 206/45.13 |
| 2,675,911 | 4/1954 | Thurston | 206/45.13 |
| 2,680,512 | 6/1954 | Young | 206/45.13 |
| 3,140,777 | 7/1964 | Gordan | 206/45.13 X |
| 4,790,435 | 12/1988 | Trusty . | |
| 4,792,058 | 12/1988 | Parker . | |
| 5,069,333 | 12/1991 | Chen . | |

FOREIGN PATENT DOCUMENTS

| | | | |
|---|---|---|---|
| 138804 | 3/1902 | Germany | 206/39 |

*Primary Examiner*—Bryon P. Gehman
*Attorney, Agent, or Firm*—Salter & Michaelson

[57] ABSTRACT

A business card case includes a shallow front lip for retaining the bottom edge of a stack of business cards and a hinge-mounted plate which is operative for lifting the top edge of a stack of business cards upwardly when the cover is opened so that the top card may be easily removed. The plate includes a flange portion which extends rearwardly from the back of the card case and a tongue portion which extends interiorly of said case. The cover includes a rear wall which extends downwardly to engage the flange when the cover is opened. Accordingly, when the cover is opened, the flange portion is pivoted downwardly and the tongue portion is pivoted upwardly to lift the top edge of the stack of business cards upwardly.

6 Claims, 2 Drawing Sheets

BUSINESS CARD CASE

BACKGROUND AND SUMMARY OF THE INVENTION

The instant invention relates to business card cases, and more particularly to a business card case including a hinged plate for lifting a top edge of a business card upwardly when the case is opened.

Business card cases have heretofore been known in the art. The heretofore known business card cases include a bottom tray which is operative for receiving a stack of business cards, and a hinged cover which hingably closes over the bottom tray. The bottom tray usually includes a front lip which cooperates with the bottom wall of the tray to form a pocket into which the business cards are received and held. In this regard, the front lip usually extends upwardly for one third to one half of the height of the business cards. Removal of a business card from the case is accomplished by grasping the top card and sliding the card out of the pocket formed by the bottom tray and the lip. While the pocket effectively holds the business cards in position within the case, it has been found that it is difficult to grasp and remove the top business card from the card case without bending the business card.

The instant invention provides a business card case having a hinged lifting plate that lifts the top edge of an enclosed stack of business cards upwardly when the cover is opened, so that the user may easily grasp and remove the top card. Briefly, the business card case comprises a base and a cover which are hingeably mounted at their respective rear edges by a hinge pin. The lifting plate is pivotably mounted on the hinge pin. The base includes a shallow front lip which is operative for receiving the bottom edge of a stack of business cards. The plate includes a tongue portion which extends into the card case and a flange portion which extends outwardly and downwardly from the back of the card case. The cover includes a mirror and rear wall portion which extends downwardly adjacent to the flange. When the cover is opened, the rear wall of the cover engages the flange portion of the plate and moves the flange portion downwardly thereby pivoting the tongue portion upwardly to lift the top edge of the stack of business cards upwardly. In this manner, when the case is opened, the business cards are moved to an inclined position. The plate further includes two upwardly extending fingers which prevent the top edge of the cards from moving toward the rear wall and becoming caught under the edge of the mirror.

Accordingly, it is an object of the instant invention to provide a business card case which more easily allows the user to grasp and remove a business card from the case without bending the card.

It is another object to provide a business case which moves the business cards to an inclined position when the case is opened.

It is yet another object to provide a business card case which lifts the top edge of the enclosed stack of cards upwardly when the cover is opened so that the top card may be easily removed.

It is still another object to provide a business card case with a hinged lifting plate that pivots the top edge of an enclosed stack of business card upwardly when the cover is opened.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENTS

Figure 1:
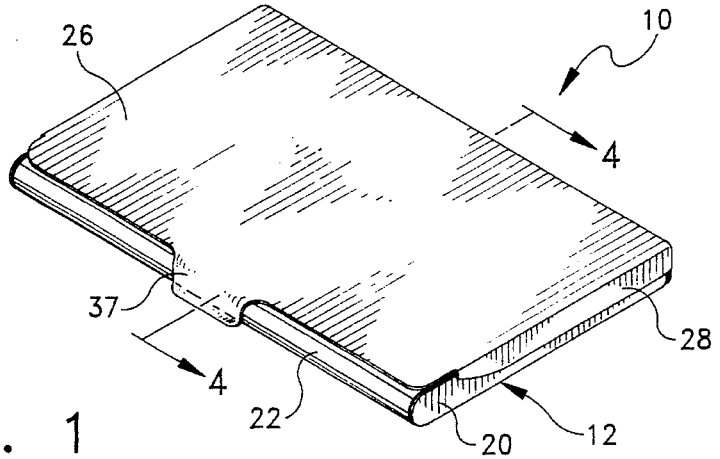
FIG. 1 is a perspective view of the business card case of the instant invention.
Figure 2:
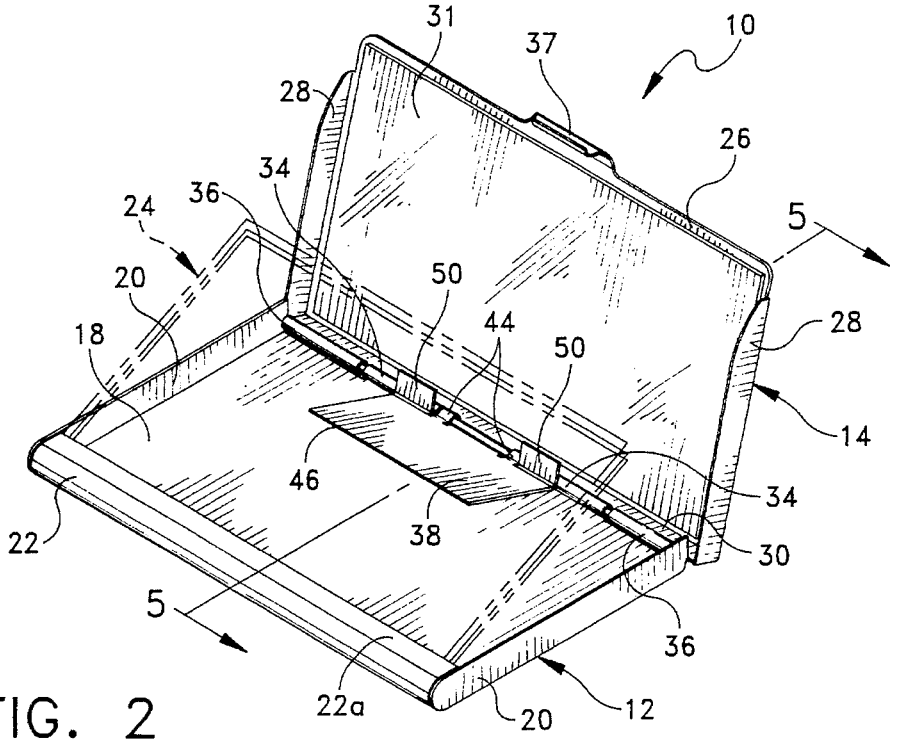
FIG. 2 is another perspective view thereof with the cover open and a stack of business cards shown in broken lines.
Figure 3:
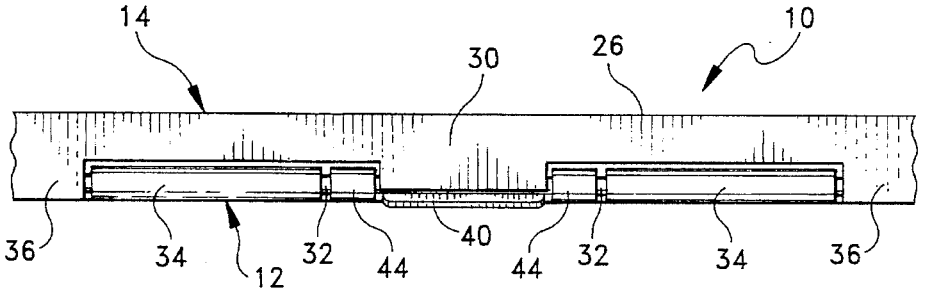
FIG. 3 is an enlarged fragmentary rear view of the instant card case showing the hinge assembly.
Figure 4:
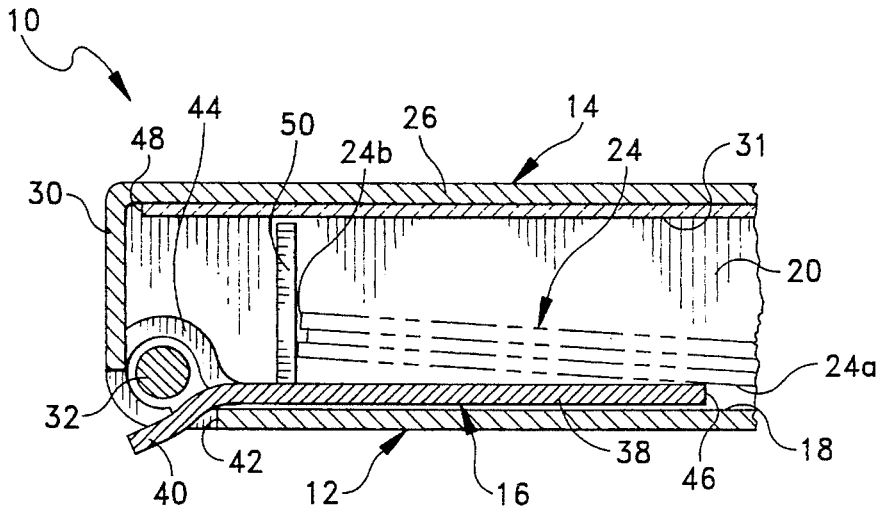
FIG. 4 is an enlarged fragmentary cross-sectional view taken along line 4—4 in FIG. 1.
Figure 5:
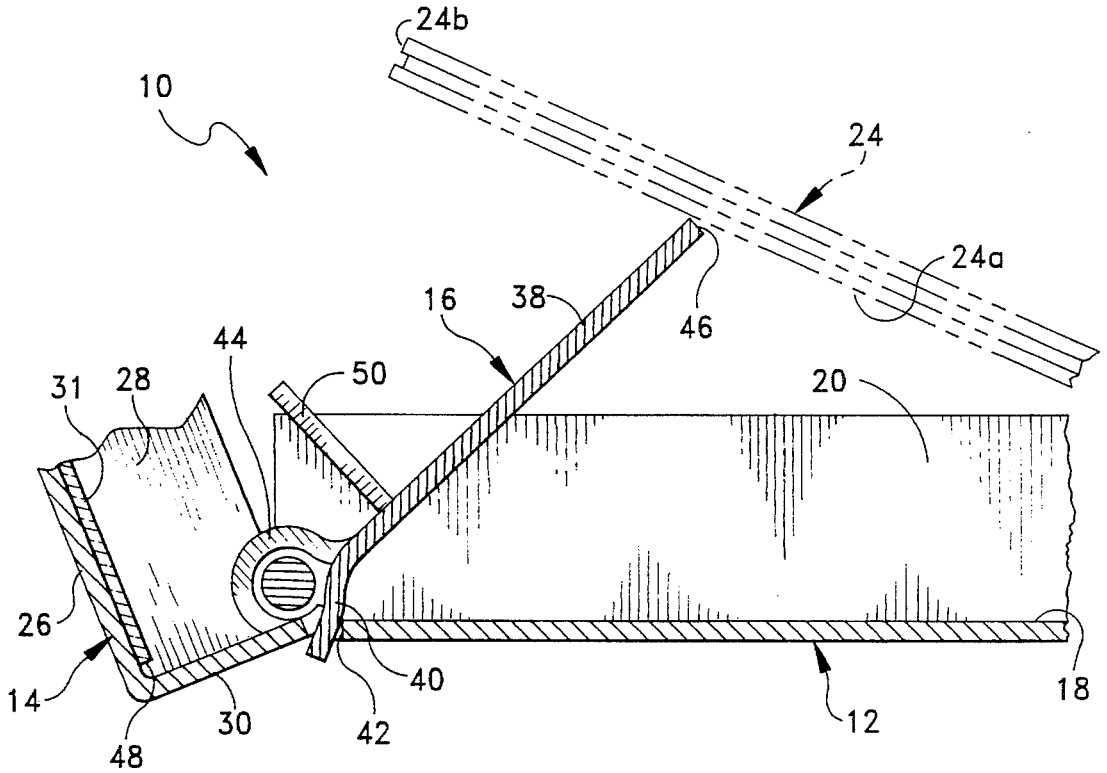
FIG. 5 is an enlarged fragmentary cross-sectional view taken along line 5—5 in FIG. 2.

Referring now to the drawings, the business card case of the instant invention is illustrated and generally indicated at 10 in FIGS. 1–6. As will hereinafter be more fully described, the instant business card case 10 is operative for lifting the top edge of an enclosed stack of business cards upwardly when the case 10 is opened so that the top card may be more easily removed. More specifically, the instant business card case 10 comprises a base generally indicated at 12, a cover generally indicated at 14 and a lifting plate generally indicated at 16. The base 12 includes a bottom wall 18, two upwardly extending sidewalls 20 and a shallow curved lip 22 which is formed at the front edge of the bottom wall 18. The shallow lip 22 is operative for receiving the bottom edge of a stack of business cards generally indicated at 24 (shown in broken lines). It will be seen in FIG. 2 that the shallow front lip 22 has a rearwardly extending portion **22*a* which overlies the adjacent end portion of the top surface of uppermost card 24, said portion 22*a* functioning as a fulcrum that enables the stack of business cards 24 to be pivoted upwardly at the bottom edge without bending. The cover 14 includes a top wall 26, two downwardly extending sidewalls 28, and a downwardly extending rear wall 30. A mirror 31 is attached to top wall 26. The base 12 and the cover 14 are hingeably connected at their respective rear edges by a hinge pin 32 which passes through aligned hinge barrels 34 and 36. (See FIGS. 2 and 3). The hinge barrels 34 are integrally formed with the base 12 and the hinge barrels 36 are integrally formed with the cover 14. In order to maintain the cover 14 in the closed position, the top wall is provided with a resilient closure tab 37 which curves downwardly. When the cover is closed (FIG. 1), the closure tab 37 is received in frictional engagement over the front lip 22 on the bottom wall 18**.

The lifting plate 16 is operative for lifting the top edge of the stack of business cards 24 upwardly when the cover 14 is opened (FIGS. 2 and 5) and it generally comprises a tongue portion 38 which extends interiorly into the card case 10, and a flange portion 40 which extends downwardly and outwardly from the card case 10 through a notch 42 which is formed in the rear edge of the bottom wall 18. The plate 16 is hingeably mounted on the hinge pin 32 by a pair of spaced hinge fingers 44 which extend rearwardly and encircle the hinge pin 32.

When the cover 14 is closed (FIGS. 1 and 4), the tongue portion 38 of the plate 16 normally rests adjacent and generally parallel to the bottom wall 18. When the cover 14 is opened (FIGS. 2 and 5), the rear wall 30 engages the flange portion 40 of the plate 16 and moves it downwardly thereby pivoting the tongue portion 38 upwardly. As the tongue portion 38 moves upwardly, the front edge 46 of the lifting plate 16 slidably engages with the bottom business card 24*a* and thereby pivots the stack of business card 24 upwardly about the bottom edge thereof, which bottom edge is captured by lips 22. With the top edge of the stack of business cards 24 elevated, the user may easily grasp and remove the top card 24*b* without bending the card 24*b*. It has been found that the top edges 24*b* of the business cards 24 often become caught under the bottom edge 48 of mirror 31 when the case 10 is opened. Accordingly, the plate 16 is provided with a pair of upwardly extending spaced fingers 50 which prevent the top edge of the business cards 24 from moving rearwardly.

It can therefore be seen that the instant invention provides a unique business card case 10 which facilitates removal of a business card 24 therefrom by automatically moving the business cards to an inclined position when the case is opened. Movement of the business cards 24 to an inclined position is accomplished by a hinged lifting plate 16 which pivots upwardly to effectively elevate the top edge of an enclosed stack of business cards 24 when the cover 14 is opened, thereby making it easier to grasp and remove the top card 24b from the case 10. When the cover 14 is closed, the plate 16 is moved back to a position adjacent to the bottom wall 18 of the case 10 and does not interfere with storage of the business cards 24. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

We claim:

1. A business card case comprising:

base and cover members hingably connected to each other whereby said cover member is movable between an open and a closed position;

a shallow front lip on said base member adapted to overlie a bottom edge of a business card positioned in said case;

a lifting plate in said case positioned adjacent a bottom of said base member so as to support a business card positioned in said case, said plate being movable between a first position where said business card is flat in said case to a second position where said business card is pivoted upwardly about its bottom edge;

apparatus for moving said plate to its said second position responsive to movement of said cover member to its open position; and said lifting plate being hingably mounted on a hinge pin, said plate including a tongue portion which extends interiorly of said case and a flange portion which extends rearwardly from said case, said cover member including a downwardly extending rear wall, said rear wall engaging said flange portion and pivoting said flange portion downwardly when said cover is moved to said open position thereby pivoting said tongue portion upwardly to pivot said business card upwardly.

2. A business card case comprising:

a base member having a rear edge;

a shallow front lip on said base member adapter to overlie a bottom edge of a business card positioned in said case;

a cover member having a rear edge and a downwardly extending rear wall, said base member and said member cover being hingeably connected at said rear edges by a hinge pin whereby said cover member is movable between an open and closed position; and a lifting plate pivotably mounted on said hinge pin and including a tongue portion extending interiorly into said card case adjacent a bottom of said base member so as to support a business card positioned in said case, said plate further including a flange portion extending outwardly and downwardly through a slot in the rear edge of said base member, said tongue portion of said plate pivoting said business card upwardly about said bottom edge when said cover member is opened wherein said rear wall of said cover member engages said flange portion of said lifting plate and moves said flange portion downwardly thereby pivoting said tongue portion upwardly to pivot said business card upwardly about said bottom edge.

3. The business card case of claim 2 further comprising closure means for releasably maintaining said cover member in said closed position.

4. In the business card case of claim 2, said lifting plate being hinged mounted on said hinge pin by a pair of spaced hinge barrels which extend rearwardly and encircle said hinge pin.

5. In the business card case of claim 2, said lifting plate further including a spaced pair of upwardly extending fingers.

6. A business card case comprising:

base and cover members hingably connected to each other whereby said cover member is movable between an open and a closed position;

said base member comprising a bottom wall having front, rear and side walls extending upwardly therefrom, said front wall having a short rearwardly extending lip at the top edge thereof which overlies a short portion of the top surface of a business card positioned in said case;

a lifting plate in said case positioned adjacent a bottom of said base member so as to support the business card positioned in said case, said plate being movable between a first position where said business card is flat in said case to a second position where said business card is pivoted upwardly with said rearwardly extending lip functioning as a fulcrum; and apparatus for moving said plate to its said second position responsive to movement of said cover member to its open position.

* * * * *